US008203275B2

(12) United States Patent
Ruxton

(10) Patent No.: US 8,203,275 B2
(45) Date of Patent: Jun. 19, 2012

(54) VARIABLE-EFFECT LIGHTING SYSTEM

(75) Inventor: James Ruxton, Toronto (CA)

(73) Assignee: Pharos Innovations, Inc. (CA)

( * ) Notice: Subject to any disclaimer, the term of this patent is extended or adjusted under 35 U.S.C. 154(b) by 230 days.

(21) Appl. No.: 12/063,905

(22) PCT Filed: Aug. 16, 2006

(86) PCT No.: PCT/CA2006/001344

§ 371 (c)(1),
(2), (4) Date: Jul. 3, 2008

(87) PCT Pub. No.: WO2007/019693

PCT Pub. Date: Feb. 22, 2007

(65) Prior Publication Data

US 2008/0315777 A1 Dec. 25, 2008

(30) Foreign Application Priority Data

Aug. 16, 2005 (CN) ..... 2005 1 0092007

(51) Int. Cl.
*H05B 37/00* (2006.01)

(52) U.S. Cl. ..... 315/185 R; 315/193; 315/307

(58) Field of Classification Search ..... 315/312, 315/224, 291, 185 S, 185 R, 193, 307
See application file for complete search history.

(56) References Cited

U.S. PATENT DOCUMENTS

| | | | | |
|---|---|---|---|---|
| 5,066,896 | A | 11/1991 | Bertenshaw et al. | |
| 5,420,482 | A | 5/1995 | Phares | |
| 6,285,140 | B1 * | 9/2001 | Ruxton | 315/312 |

FOREIGN PATENT DOCUMENTS

| | | | |
|---|---|---|---|
| CA | 2 371 167 | | 11/2001 |
| DE | 10353460 | | 6/2005 |
| GB | 2 244 358 | | 11/1991 |
| WO | WO 01/24146 | A1 | 4/2001 |
| WO | WO 03/069223 | A1 | 8/2003 |

OTHER PUBLICATIONS

EPO Search Report and Written Opinion for EP Apln. 06775119.8-226/1929843 PCT/CA2006001344, dated Sep. 17, 2010.

* cited by examiner

*Primary Examiner* — David Hung Vu
(74) *Attorney, Agent, or Firm* — Greenberg Traurig LLP

(57) ABSTRACT

A variable-effect lighting system includes a lamp assembly and a lamp controller coupled to the lamp assembly. The lamp assembly comprises a number of multi-coloured lamps in series with an AC voltage source and in series with each other. Each multi-coloured lamp comprises a first illuminating element for producing a first colour of light, and a second illuminating element for producing a second colour of light. The lamp controller is configured to vary the colour produced by the lamps by varying the conduction interval of each illuminating element according to a predetermined pattern. The controller is also configured to terminate the variation upon activation of a user-operable input to the controller.

17 Claims, 10 Drawing Sheets

VARIABLE-EFFECT LIGHTING SYSTEM

This application is a U.S. non-provisional national phase application of international application PCT/CA2006/001344, filed 16 Aug. 2006, which, in turn, claims the benefit of the thing date of prior Chinese patent application 200510092007.1, flied 16 Aug. 2005.

FIELD OF THE INVENTION

The present invention relates to variable-effect lighting systems. In particular, the present invention relates to a lighting system having coloured lamps for producing a myriad of colour displays.

BACKGROUND OF THE INVENTION

Variable-effect lighting systems are commonly used for advertising, decoration, and ornamental or festive displays. Such lighting systems frequently include a set of coloured lamps packaged in a common fixture, and a control system which controls the output intensity of each lamp in order to control the colour of light emanating from the fixture.

For instance, Kazar (U.S. Pat. No. 5,008,595) teaches a light display comprising strings of bicoloured LED packages connected in parallel across a common DC voltage source. Each bicoloured LED package comprises a pair of red and green LEDs, connected back-to-back, with the bicoloured LED packages in each string being connected in parallel to the voltage source through an H-bridge circuit. A control circuit, connected to the H-bridge circuits, allows the red and green LEDS to conduct each alternate half cycle, with the conduction angle each half cycle being determined according to a modulating input source coupled to the control circuit. However, the rate of change of coloured light produced is restricted by the modulating input source. Therefore, the range of colour displays which can be produced by the light display is limited.

Phares (U.S. Pat. No. 5,420,482) teaches a controlled lighting system which allows a greater range of colour displays to be realized. The lighting system comprises a control system which transmits illumination data to a number of lighting modules. Each lighting module includes at least two lamps and a control unit connected to the lamps and responsive to the illumination data to individually vary the amount of light emitted from each lamp. However, the illumination data only controls the brightness of each lamp at any given instant. Therefore, the lighting system is not particularly well suited to easily producing intricate colour displays.

Murad (U.S. Pat. No. 4,317,071) teaches a computerized illumination system for producing a continuous variation in output colour. The illumination system comprises a number of different coloured lamps, a low frequency clock, and a control circuit connected to the low frequency clock and to each coloured lamp for varying the intensity of light produced by each lamp. However, the rate of change of lamp intensity is dictated by the frequency of the low frequency clock, and the range of colour displays is limited.

Gomoluch (GB 2,244,358) discloses a lighting control system which includes a lighting control unit, and a string of light units connected to the lighting control unit. The lighting control unit includes a DC power supply unit, a microprocessor, a read-only memory containing display bit sequences, and switches for allowing users to select a display bit sequence. Each light unit includes a bi-coloured LED, and data storage elements each connected in parallel to the DC power output of the lighting control unit and in series with data and clock outputs of the microprocessor. The microprocessor clocks the selected bit patterns in serial fashion to the storage elements. The data storage elements received each data bit, and illuminate or extinguish the associated LED.

However, Gomoluch requires that complex light units be used. Therefore, there remains a need for a relatively simple variable-effect lighting system which allows for greater variation in the range of colour displays which can be realized.

SUMMARY OF THE INVENTION

According to the present invention, there is provided a variable-effect lighting system comprising a lamp assembly, and a lamp controller coupled to the lamp assembly.

In a first aspect of the invention, the lamp assembly comprises a plurality of multi-coloured lamps in series with an AC voltage source and in series with each other. Each multi-coloured lamp comprises a first illuminating element for producing a first colour of light, and a second illuminating element for producing a second colour of light. The lamp controller is configured to vary the colour produced by the lamps by varying a conduction interval of each said illuminating element according to a predetermined pattern. The controller is also configured to terminate the variation upon activation of a user-operable input to the controller.

In a second aspect of the invention, the lamp assembly comprises a plurality of multi-coloured lamps in series with an AC voltage source and in series with each other. Each multi-coloured lamp comprises a first illuminating element for producing a first colour of light, and a second illuminating element for producing a second colour of light. The lamp controller is configured to vary the colour produced by the lamps by varying the conduction interval of each illuminating element according to an external signal input to the lamp controller.

In a third aspect of the invention, the lamp assembly comprises a plurality of multi-coloured lamps in series with an AC voltage source and in series with each other. Each multi-coloured lamp comprises a first illuminating element for producing a first colour of light, and a second illuminating element for producing a second colour of light. The lamp controller is configured to control the current draw of each said illuminating element in accordance with the frequency of the voltage source.

In a fourth aspect of the invention, the variable-effect lighting system includes a first lamp assembly comprising a plurality of first multi-coloured lamps in parallel with an AC voltage source and in series with each other, and a first lamp controller coupled to the first lamp assembly for controlling a first colour of light produced by the first multi-coloured lamps. The lighting system also includes a second lamp assembly comprising a plurality of second multi-coloured lamps in parallel with the AC voltage source and in series with each other; and a second lamp controller coupled to the second lamp assembly for controlling a second colour of light produced by the second multi-coloured lamps. The first lamp controller is configured to vary the first produced colour. The second lamp controller is configured to vary the second produced colour in synchronization with the first produced colour.

In a fifth aspect of the invention, the lamp assembly comprises a plurality of multi-coloured lamps in parallel with a DC voltage source. Each multi-coloured lamp comprises a first illuminating element for producing a first colour of light, and a second illuminating element for producing a second colour of light different from the first colour. The lamp controller includes a first electronic switch coupled to all of the first illuminating elements and a second electronic switch coupled to all of the second illuminating elements. The lamp controller is configured to set the conduction angle of each illuminating element according to at least one predetermined pattern, the controller being configured with the predetermined patterns.

BRIEF DESCRIPTION OF THE DRAWINGS

The preferred embodiments of the invention will now be described, by way of example only, with reference to the drawings, in which.

DETAILED DESCRIPTION OF THE PREFERRED EMBODIMENTS

Figure 1A:
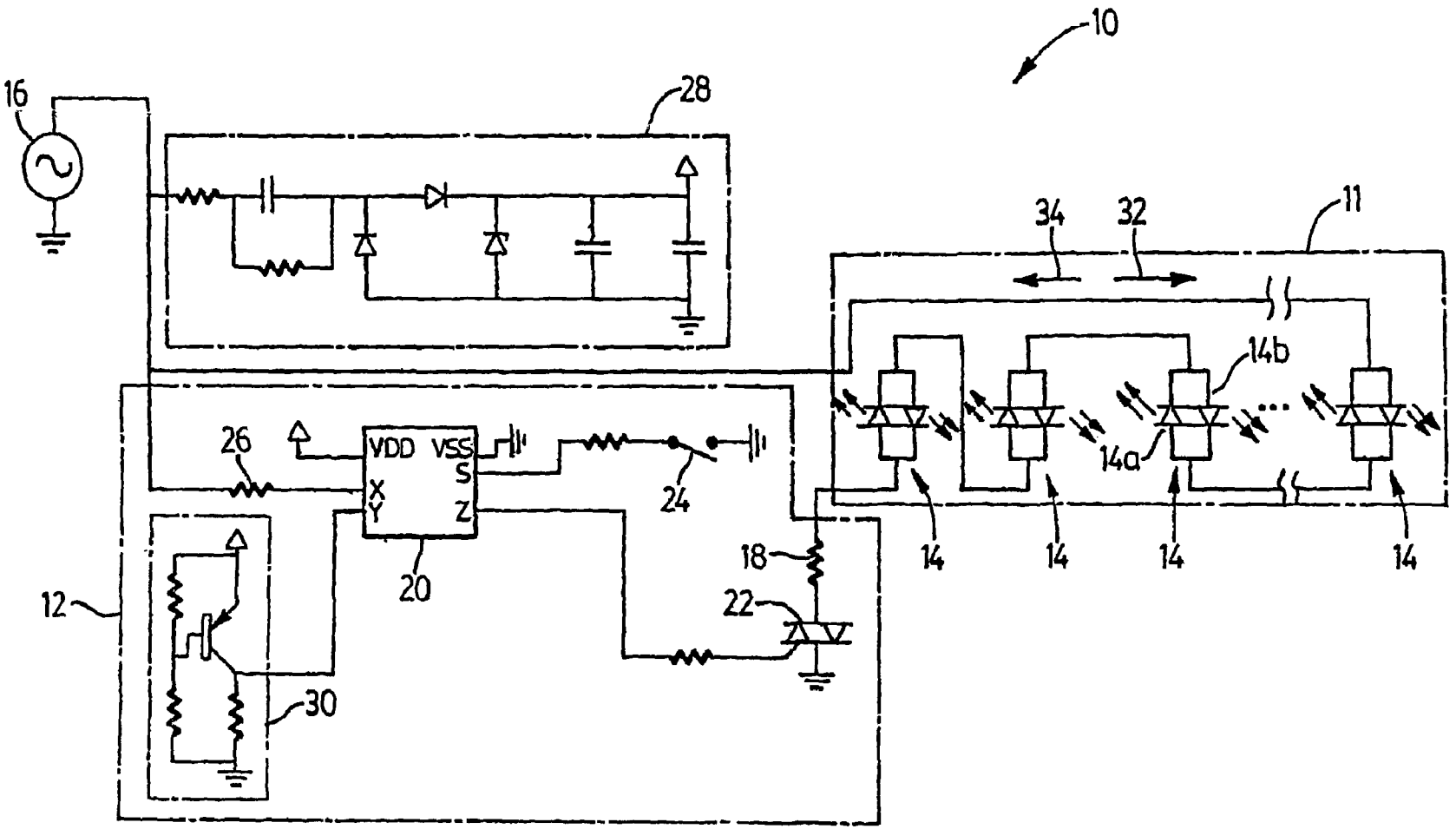
FIG. 1*a* is a schematic circuit diagram of a variable-effect lighting system according to a first embodiment of the invention, showing a lamp controller, and a lamp assembly comprising a string of series-coupled bicoloured lamps.

Turning to FIG. 1*a*, a variable-effect lighting system according to a first embodiment of the invention, denoted generally as 10, is shown comprising a lamp assembly 11, and a lamp controller 12 coupled to the lamp assembly 11 for setting the colour of light produced by the lamp assembly 11. Preferably, the lamp assembly 11 comprises string of multi-coloured lamps 14 interconnected with flexible wire conductors to allow the ornamental lighting system 10 to be used as decorative Christmas tree lights. However, the multi-coloured lamps 14 may also be interconnected with substantially rigid wire conductors or affixed to a substantially rigid backing for applications requiring the lamp assembly 11 to have a measure of rigidity.

The multi-coloured lamps 14 are connected in series with each other and with an AC voltage source 16, and a current-limiting resistor 18. Typically the AC voltage source 16 comprises the 60 Hz 120 VAC source commonly available. However, other sources of AC voltage may be used without departing from the scope of the invention. As will be appreciated, the series arrangement of the lamps 14 eliminates the need for a step-down transformer between the AC voltage source 16 and the lamp assembly 11. The current-limiting resistor 18 limits the magnitude of current flowing through the lamps 14. However, the current-limiting resistor 18 may be eliminated if a sufficient number of lamps 14 are used, or if the magnitude of the voltage produced by the AC voltage source 16 is selected so that the lamps 14 will not be exposed to excessive current flow.

Preferably, each lamp 14 comprises a bicoloured LED having a first illuminating element for producing a first colour of light, and a second illuminating element for producing a second colour of light which is different from the first colour, and with the leads of each lamp 14 disposed such that when current flows through the lamp 14 in one direction the first colour of light is produced, and when current flows through the lamp 14 in the opposite direction the second colour of light is produced. As shown in FIG. 1*a*, preferably each bicoloured LED comprises a pair of differently-coloured LEDs 14*a*, 14*b* connected back-to-back, with the first illuminating element comprising the LED 14*a* and the second illuminating element comprising the LED 14*b*.

In a preferred implementation of the invention, the first illuminating element produces red light, and the second illuminating element produces green light. However, other LED colours may be used if desired. In addition, both LEDs 14*a*, 14*b* of some of the lamps 14 may be of the same colour if it is desired that some of the lamps 14 vary the intensity of their respective colour outputs only. Further, each lamp 14 may be fitted with a translucent ornamental bulb shaped as a star, or a flower or may have any other aesthetically pleasing shape for added versatility.

Preferably, the lamp controller 12 comprises a microcontroller 20, a bidirectional semiconductor switch 22 controlled by an output Z of the microcontroller 20, and a user-operable switch 24 coupled to an input S of the microcontroller 20 for selecting the colour display desired. In addition, an input X of the microcontroller 20 is coupled to the AC voltage source 16 through a current-limiting resistor 26 for synchronization purposes, as will be described below. The bidirectional switch 22 is positioned in series with the lamps 14, between the current limiting resistor 18 and ground. In FIG. 1*a*, the bidirectional switch 22 is shown comprising a triac switch. However, other bidirectional switches, such as IGBTs or back-to-back SCRs, may be used without departing from the scope of the invention.

The lamp controller 12 is powered by a 5-volt DC regulated power supply 28 connected to the AC voltage source 16 which ensures that the microcontroller 20 receives a steady voltage supply for proper operation. However, for added safety, the lamp controller 12 also includes a brownout detector 30 connected to an input Y of the microcontroller 20 for placing the microcontroller 20 in a stable operational mode should the supply voltage to the microcontroller 20 drop below acceptable limits.

Preferably, the microcontroller 20 includes a non-volatile memory which is programmed or "burned-in" with preferably several conduction angle patterns for setting the conduction angle of the bidirectional switch 22 in accordance with the pattern selected. In this manner, the conduction angles of the LEDs 14*a*, 14*b* (and hence the colour display generated by the bicoloured lamps 14) can be selected. Alternately, the microcontroller 20 may be replaced with a dedicated integrated circuit (ASIC) that is "hard-wired" with one or more conduction angle patterns.

Preferred colour displays include, but are not limited to:

1. continuous slow colour change between red, amber and green
2. continuous rapid colour change between red, amber and green
3. continuous alternate flashing of red and green
4. continuous random flashing of red and green
5. continuous illumination of red only
6. continuous change in intensity of red
7. continuous flashing of red only
8. continuous illumination of green only
9. continuous change in intensity of green
10. continuous flashing of green only
11. continuous illumination of red and green to produce amber
12. combination of any of the preceding colour displays However, as will be appreciated, the microcontroller 20 need only be programmed with a single conduction angle pattern to function. Further, the microcontroller 20 needs only to be programmed in situ with a user interface (not shown) for increased flexibility. As will be apparent, if the microcontroller 20 is programmed with only a single conduction angle pattern, the user-operable switch 24 may be eliminated from the lamp controller 12. Further, the user-operable switch 24 may be eliminated even when the microcontroller 20 is programmed with a number of conduction angle patterns, with the microcontroller 20 automatically switching between the various conduction angle patterns. Alternately, the user-operable switch 24 may be replaced with a clock circuit which signals the microcontroller 20 to switch conduction angle patterns according to the time.

The operation of the variable-effect lighting system 10 will now be described. Prior to power-up of the lighting system 10, the microcontroller 20 is programmed with at least one conduction angle pattern. Alternately, the microcontroller 20 is programmed after power-up using the above-described user interface. Once power is applied through the AC voltage source 16, the 5-volt DC regulated power supply 28 provides power to the microcontroller 20 and the brown-out detector 30.

After the brown-out detector 30 signals the microcontroller 20 at input Y that the voltage supplied by the power supply 28 has reached the threshold sufficient for proper operation of the microcontroller 20, the microcontroller 20 begins executing instructions for implementing a default conduction angle pattern. However, if a change of state is detected at the input S by reason of the user activating the user-operable switch 24, the microcontroller 20 will begin executing instructions for implementing the next conduction angle pattern. For instance, if the microcontroller 20 is executing instructions for implementing the third conduction angle pattern identified above, actuation of the user-operable switch 24 will force the microcontroller 20 to being executing instructions for implementing the fourth conduction angle pattern.

For ease of explanation, it is convenient to assume that the LED 14*a* is a red LED, and the LED 14*b* is a green LED. It is also convenient to assume that the first conduction angle pattern, identified above, is selected. The operation of the lighting system 10 for the remaining conduction angle patterns will be readily understood from the following description by those skilled in the art.

After the conduction angle pattern is selected, either by default or by reason of activation of the user-operable switch 24, the microcontroller 20 will begin monitoring the AC signal received at the input X to the microcontroller 20. Once a positive-going zero-crossing of the AC voltage source 16 is detected, the microcontroller 20 delays a predetermined period. After the predetermined period has elapsed, the microcontroller 20 issues a pulse to the bidirectional switch 22, causing the bidirectional switch 22 to conduct current in the direction denoted by the arrow 32. As a result, the red LED 14*a* illuminates until the next zero-crossing of the AC voltage source 16. In addition, while the LED 14*a* is conducting current, the predetermined period for the LED 14*a* is increased in preparation for the next positive-going zero-crossing of the AC voltage source 16.

After the negative-going zero-crossing of the AC signal source 16 is detected at the input X, the microcontroller 20 again delays a predetermined period. After the predetermined period has elapsed, the microcontroller 20 issues a pulse to the bidirectional switch 22, causing the bidirectional switch 22 to conduct current in the direction denoted by the arrow 34. As a result, the green LED 14*b* illuminates until the next zero-crossing of the AC voltage source 16. In addition, while the LED 14*b* is conducting current, the predetermined period for the LED 14*b* is decreased in preparation for the next negative-going zero-crossing of the AC voltage source 16.

With the above conduction angle sequence, it will be apparent that the period of time each cycle during which the red LED 14*a* illuminates will continually decrease, while the period of time each cycle during which the green LED 14*b* illuminates will continually increase. Therefore, the colour of light emanating from the bicoloured lamps 14 will gradually change from red, to amber, to green, with the colour of light emanating from the lamps 14 when both the LEDs 14*a*, 14*b* are conducting being determined by the instantaneous ratio of the magnitude of the conduction angle of the LED 14*a* to the magnitude of the conduction angle of the LED 14*b*.

When the conduction angle of the green LED 14*b* reaches 180°, the conduction angle pattern is reversed so that the colour of light emanating from the bicoloured lamps 14 changes from green, to amber and back to red. As will be appreciated, the maximum conduction angles for each conducting element of the lamps 14 can be set less than 180° if desired.

In a preferred implementation of the invention, the microcontroller 20 comprises a Microchip PIC12C508 microcontroller. The zero-crossings of the AC voltage source 16 are detected at pin 3, the state of the user-operable switch 24 is detected at pin 7, and the bidirectional switch 22 is controlled by pin 6. The brown-out detector 30 is coupled to pin 4.

A sample assembly code listing for generating conduction angle patterns 1, 2 and 3 with the Microchip PIC12C508 microcontroller is shown in Table A.

TABLE A

```
; Constants
    AC_IN EQU 4;     GP4 (pin 3) is AC input pin X
    TRIGGER_OUT EQU 1; GP1 (pin 6) is Triac Trigger pin Z
    BUTTON EQU 0; GP0 (pin 7) is input pin S and is active low
    delay_dim EQU 0x007
    dim_val EQU 0x008
    trigger_delay EQU 0x009
    DELAY1 EQU 0x00A
```

TABLE A-continued

```
    DELAY2 EQU 0x00B
    DELAY3 EQU 0x00C
    RED_INTENSITY EQU 0x00D
    SUBTRACT_REG EQU 0x00E
    DELAY5 EQU 0x00F
    FLASH_COUNT EQU 0x010
    FLASH_COUNT_SHAD EQU 0x011
    FADE_DELAY EQU 0x012
    org 0;          RESET vector location
    movwf OSCCAL;   move data from W register to OSCCAL
    goto START
DELAY;              subroutine to delay 83 usec * register W
    movwf dim_val;
LOOP1
    movlw .27
    movwf delay_dim
LOOP2;    delay 83 usec
    decfsz delay_dim,1
    goto LOOP2
    decfsz dim_val,1
    goto LOOP1
return
TRIGGER;            subroutine to send trigger pulse to triac
    bsf GPIO,TRIGGER_OUT
                    movlw b'00010001'
                    TRIS GPIO;      send trigger to triac
    movlw .30
    movwf trigger_delay
LOOP3
    decfsz trigger_delay,1
    goto LOOP3;                     delay 30 usec
                    movlw b'00010011'
                    TRIS GPIO;  remove trigger from triac
return
DELAY_SEC
    movlw .4
    movwf DELAY3;                   set DELAY3
SEC2
    movlw .250
    movwf DELAY2;                   set DELAY2
QUART_SEC2
    movlw .250
    movwf DELAY1;                   set DELAY1
MSEC2
    clrwdt;    clear Watchdog timer
    decfsz DELAY1,1;                wait DELAY1
    goto MSEC2
    decfsz DELAY2,1;                wait DELAY2 * DELAY1
    goto QUART_SEC2
    decfsz DELAY3,1:                wait DELAY3 * DELAY2 * DELAY1
    goto SEC2
return
FADE_SUB;           subroutine to vary conduction angle for triac
                    each half cycle
UP_LOOP;            increase delay before triac starts to conduct
                    each negative half cycle while decreasing delay
                    each positive half cycle
    btfss GPIO,AC_IN
    goto UP_LOOP;                   wait for positive swing on AC input
WAIT_NEG1
    call WAIT_NEG_EDGE1;            increase delay before turning triac on each
                                    negative half cycle
NO_CHANGE
    movlw .90;                      register W = maximum delay value
                                    before triac turns on
    subwf RED_INTENSITY,0
    btfsc STATUS,Z
    goto WAIT_NEG2;                 if RED_INTENSITY is equal to maximum delay
                                    value, start increasing delay value
    movf RED_INTENSITY,0
    btfss GPIO,BUTTON
return;                             return if Button depressed
    call DELAY;                     delay RED_INTENSITY * 83 usec
    call TRIGGER;                   send trigger pulse to triac
MAIN_LOOP2
    btfsc GPIO,AC_IN
    goto MAIN_LOOP2; wait for negative swing on AC input
WAIT_POS_EDGE1
    btfss GPIO,AC_IN
    goto WAIT_POS_EDGE1;            wait for positive swing on AC input
```

TABLE A-continued

```
        movlw .96
        movwf SUBTRACT_REG;         SUBTRACT_REG = maximum delay value +
                                    minimum delay value before triac turns on
        movf RED_INTENSITY,0
        subwf SUBTRACT_REG,0
        call DELAY;                 delay (SUBTRACT_RED−RED_INTENSITY) * 83 usec
        call TRIGGER;               send trigger pulse to triac
        goto UP_LOOP
    DOWN_LOOP
        btfss GPIO,AC_IN
        goto DOWN_LOOP; wait for positive swing on AC input
    WAIT_NEG2
        call WAIT_NEG_EDGE2;        decrease delay before triac turns on each
                                    negative half cycle
    NO_CHANGE2
        movlw .6
        subwf RED_INTENSITY,0;      register W = RED_INTENSITY − minimum delay
                                    value
        btfsc STATUS,Z
        goto WAIT_NEG1;             if RED_INTENSITY is equal to minimum delay
                                    value, start increasing delay
        movf RED_INTENSITY,0
        btfss GPIO,BUTTON
    return;                         return if Button depressed
        call DELAY;                 delay RED_INTENSITY * 83 usec
        call TRIGGER;               send trigger pulse to triac
    MAIN_LOOP3
        btfsc GPIO,AC_IN
        goto MAIN_LOOP3; wait for negative swing on AC input
    WAIT_POS_EDGE2
        btfss GPIO,AC_IN
        goto WAIT_POS_EDGE2;        wait for positive swing on AC input
        movlw .96
        movwf SUBTRACT_REG;         SUBTRACT_REG = maximum delay value before
                                    triac turns on
        movf RED_INTENSITY,0
        subwf SUBTRACT_REG,0
        call DELAY;                 delay (SUBTRACT_REG-RED_INTENSITY) * 83 usec
        call TRIGGER;               send trigger pulse to triac
        goto DOWN_LOOP
    return
    WAIT_NEG_EDGE1; routine to increase delay before triac turns
                ; on each negative half cycle
        btfsc GPIO,AC_IN;           wait for negative swing on AC input
        goto WAIT_NEG_EDGE1
        decfsz DELAY5,1;            DELAY5 = fade delay (number of cycles at present delay)
                                    value; decrement and return if not zero
    return
        incf RED_INTENSITY,1;       otherwise, increment delay and return
        movf FADE_DELAY,0
        movwf DELAY5
    return
    WAIT_NEG_EDGE2;                 routine to decrease delay before triac turns
                                    on each negative half cycle
        btfsc GPIO,AC_IN;           wait for negative swing on AC input
        goto WAIT_NEG_EDGE2
        decfsz DELAY5,1;            DELAY5 = number of cycles at present delay value;
decrement and return if not zero
    return
        decf RED_INTENSITY,1;       otherwise decrement delay and return
        movf FADE_DELAY,0
        movwf DELAY5;               DELAY5 = FADE_DELAY
    return
    FLASH_SUB;                      subroutine to flash lights at speed dictated by
                                    value assigned to FLASH_COUNT_SHAD
        movf FLASH_COUNT_SHAD,0
        movwf FLASH_COUNT;          FLASH_COUNT = duration of flash
    MAIN_LOOP4
        btfsc CPIO,AC_IN;           wait for negative swing on AC input
        goto MAIN_LOOP4
    WAIT_POS_EDGE4
        btfsc GPIO,AC_IN
        goto WAIT_POS_EDGE4;        wait for positive swing on AC input
        movlw .6
        call DELAY
        call TRIGGER;               send trigger pulse to triac
        btfss GPIO,BUTTON
    return;                         return if Button pressed
        decfsz FLASH_COUNT
        goto MAIN_LOOP4;            decrement FLASH_COUNT and repeat until zero
```

TABLE A-continued

```
        movf FLASH_COUNT_SHAD,0
        movwf FLASH_COUNT;              reset FLASH_COUNT
DOWN_LOOP4
        btfss GPIO,AC_IN;               wait for positive swing on AC input
        goto DOWN_LOOP4
WAIT_NEG_EDGE4
        btfsc GPIO,AC_IN
        goto WAIT_NEG_EDGE4;            wait for negative swing on AC input
        movlw .6
        call DELAY
        call TRIGGER                    send trigger pulse to triac
        btfss GPIO,BUTTON
return;                                 return if Button pressed
        decfsz FLASH_COUNT
        goto DOWN_LOOP4;                decrement FLASH_COUNT and repeat until zero
return
START
        movlw b'00010011'
        TRIS GPIO;   set pins GP4 (AC input), GP1 (Triac output to high
                     impedance), GP0 (Button as input)
        movlw b'10010111'; enable pullups on GP0, GP1, GP3
OPTION
        movlw .4
        movwf RED_INTENSITY;            load RED_INTENSITY register
        movlw .5
        movwf DELAY5;                   set initial fade
FADE_SLOW
        call DELAY_SEC;             wait DELAY3 * DELAY2 * DELAY1
        movlw .5
        movwf FADE_DELAY;           set slow FADE_DELAY
        call FADE_SUB;              slowly fade colours until Button is pressed
        goto FADE_FAST
FADE_FAST
        call DELAY_SEC;             wait DELAY3 * DELAY2 * DELAY1
        movlw .1
        movwf FADE_DELAY;           set fast FADE_DELAY
        call FADE_SUB;              rapidly fade colours until Button is pressed
        goto FLASH2_SEC
FLASH2_SEC ; flash red/green 2 sec interval
        call DELAY_SEC;             wait DELAY3 * DELAY2 * DELAY1
        movlw .120
        movwf FLASH_COUNT_SHAD
FLASH2B_SEC
        btfss GPIO,BUTTON
        goto FLASH1_SEC;            slowly flash lights until Button is pressed
        call FLASH_SUB
        goto FLASH2B_SEC
FLASH1_SEC ; flash red/green 1 sec. interval
        call DELAY_SEC;             wait DELAY3 * DELAY2 * DELAY1
        movlw .60
        movwf FLASH_COUNT_SHAD
FLASH1B_SEC
        btfss GPIO,BUTTON
        goto FLASH_FAST;            flash lights at moderate speed until
                                    Button is pressed
        call FLASH_SUB
        goto FLASH1B_SEC
FLASH_FAST ; flash red/green 0.25 sec. interval
        call DELAY_SEC;             wait DELAY3 * DELAY2 * DELAY1
        movlw .15
        movwf FLASH_COUNT_SHAD
FLASH_FASTB
        btfss GPIO,BUTTON
        goto FADE_SLOW;             rapidly flash lights until Button is pressed
        call FLASH_SUB;             slowly fade colours if Button is pressed
        goto FLASH_FASTB
end
```

Numerous variations of the lighting system 10 are possible. In one variation (not shown), the user-operable switch 24 is replaced with a temperature sensor coupled to the input S of the microcontroller 20 for varying the conduction angle pattern according to the ambient temperature. Alternately, the lamp controller 12 includes a plurality of temperature sensors, each being sensitive to a different temperature range, and being coupled to a respective input of the microcontroller 20. With this variation, one colour display is produced when the ambient temperature falls within one range and another colour display is produced when the ambient temperature falls within a different range.

In another variation, the lamp controller 12 includes a motion or proximity sensor coupled to an appropriate input of the microcontroller 20. With this variation, one colour display is produced when motion or an object (such as a person) is detected, and another colour display is produced when no motion or object is detected.

Figure 1B:
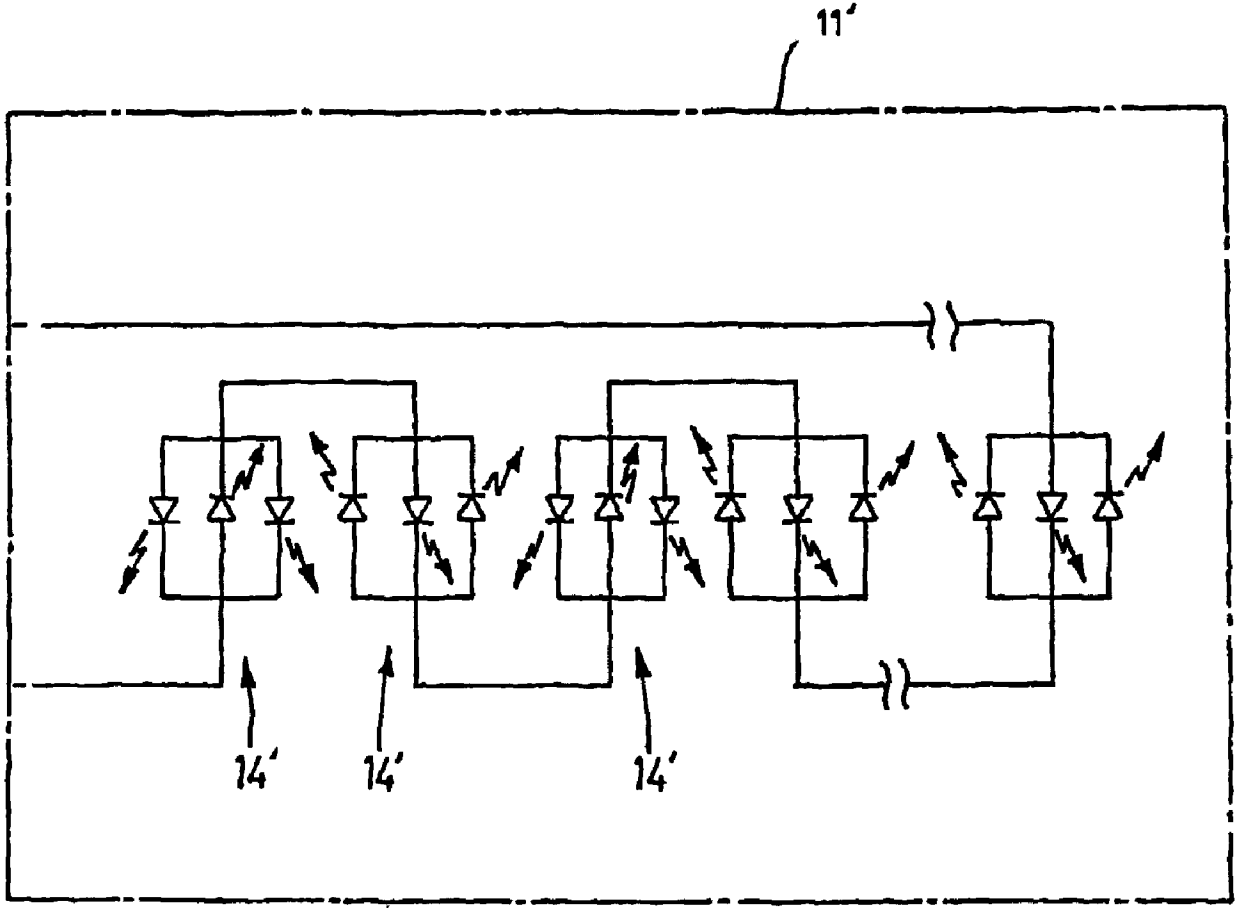
FIG. 1*b* is a schematic circuit diagram of one variation of the lamp assembly shown in FIG. 1*a;*

In yet another variation (not shown), each lamp 14 comprises a pair of LEDs with one of the LEDs being capable of emitting white light and with the other of the LEDs being capable of producing a colour of light other than white. In still another variation, each lamp 14 comprises a LED capable of producing three or more different colours of light, while in the variation shown in FIG. 1*b*, each lamp 14 comprises three or more differently-coloured LEDs. In these latter two variations, the LEDs are connected such that when current flows in one direction one colour of light is produced, and when current flows in the opposite direction another colour of light is produced.

Figure 1C:
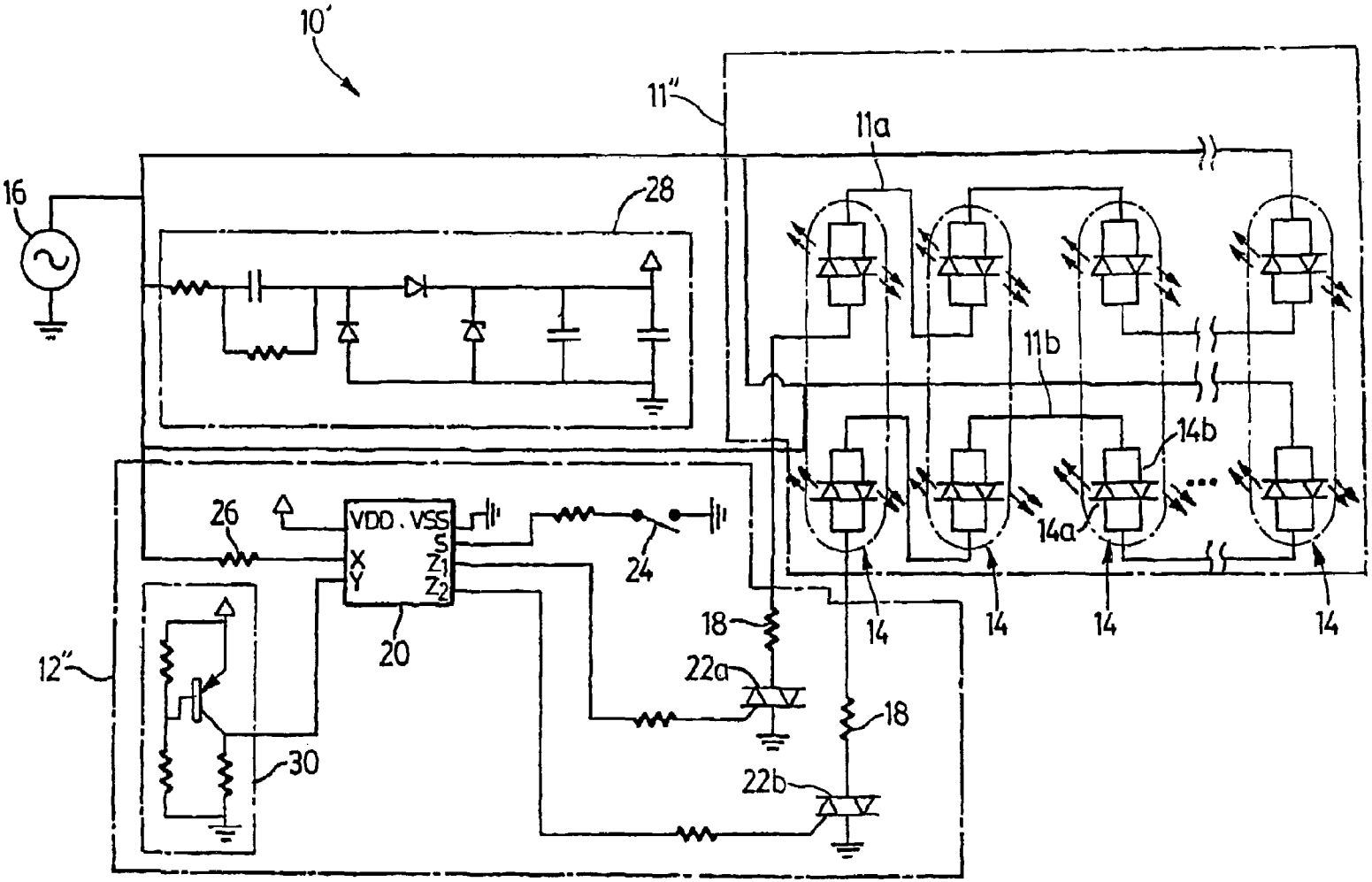
FIG. 1*c* is a schematic circuit diagram of a variable-effect lighting system, according to a second embodiment of the invention.

A second embodiment of the lighting system is depicted in FIG. 1*c*. As shown, the lamp controller 12 comprises two bidirectional switches 22*a*, 22*b* each connected to a respective output Z1, Z2 of the microcontroller 20. The lamp assembly 11 comprises first and second strings 11*a*, 11*b* of series-connected back-to-back-coupled LEDs 14*a*, 14*b*, with each string 11*a*, 11*b* being connected to the AC voltage source 16 and to a respective one of the bidirectional switches 22*a*, 22*b*. In this variation, each multi-coloured lamp 14 comprises one pair of the back-to-back-coupled LEDs 14*a*, 14*b* of the first string 11*a* and one pair of the back-to-back-coupled LEDs 14*a*, 14*b* of the second string 11*b*, with the LEDs of each lamp 14 being inserted in a respective translucent ornamental bulb. As a result, the colour of light emanating from each bulb depends on the instantaneous ratio of the conduction angles of the LEDs 14*a*, 14*b* in both strings 11*a*, 11*b*. Preferably, the outputs Z1, Z2 are independently operable to increase the range of colour displays.

In one variation, the lamp controller 12 is similar to the lamp controller 12 shown in FIG. 1*c*, in that it comprises two bidirectional switches 22*a*, 22*b* each connected to a respective independently-operable output Z1, Z2 of the microcontroller 20. However, unlike the lamp controller 12 shown in FIG. 1*c*, the lamp assembly 11 comprises first and second strings 11*a*, 11*b* of series-connected single-coloured lamps 14. As above, each singly-coloured lamp 14 of the first string 11*a* is associated with a singly-coloured lamp 14 of the second string 11*b*, with each associated lamp pair being inserted in a respective translucent ornamental bulb.

Figure 1D:
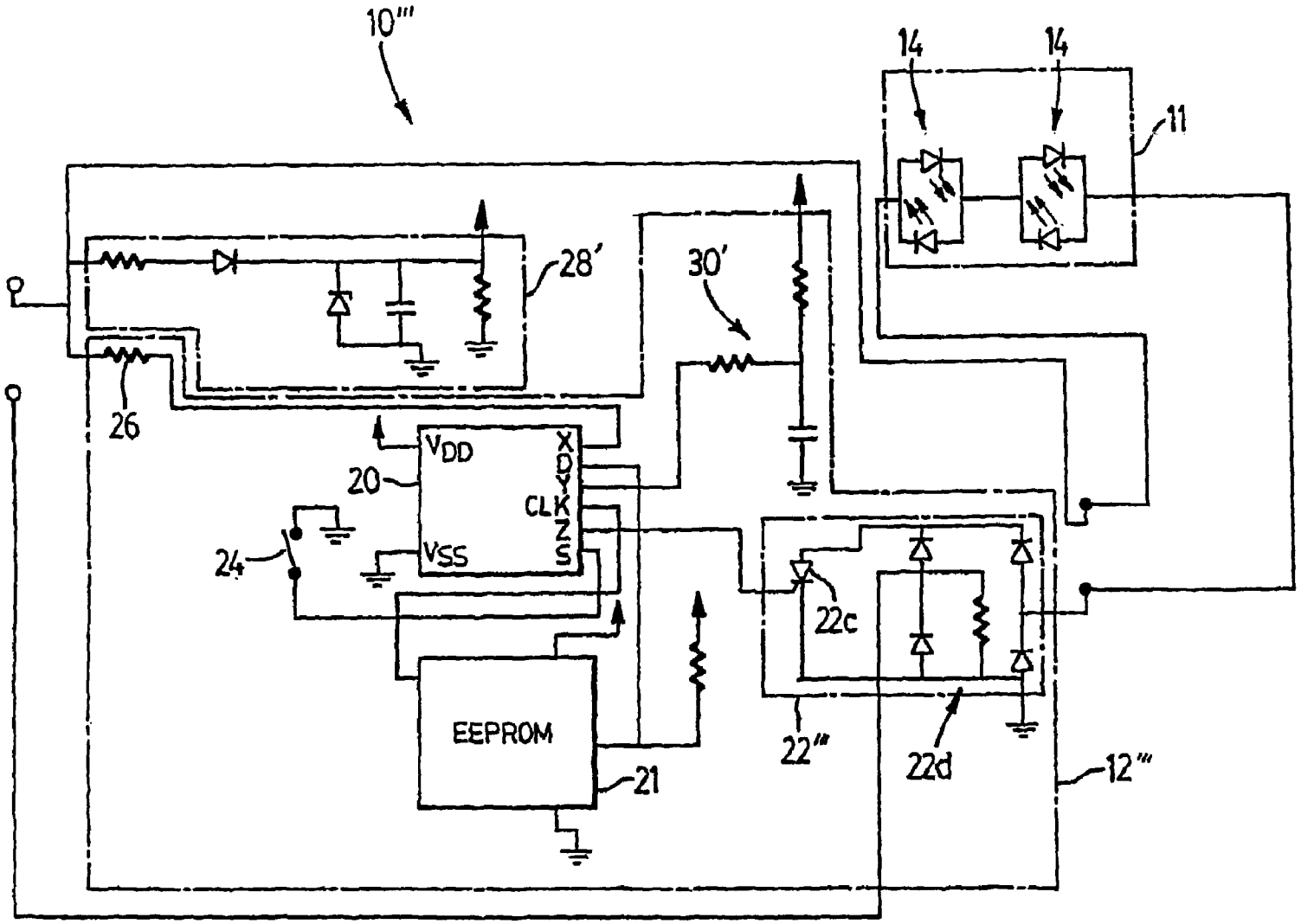
FIG. 1*d* is a schematic circuit diagram of a variable-effect lighting system, according to a third embodiment of the invention.

A third embodiment of the lighting system is depicted in FIG. 1*d*. As shown, the lighting system 10''' comprises a RC power-up circuit 30' for placing the microcontroller 20 in a known state at power up, and an EEPROM 21 connected to the microcontroller 20 for retaining a data element identifying the selected conduction angle pattern so that the lighting system 110''' implements the previously selected conduction angle pattern after power up. As will be apparent, the EEPROM 21 may be implemented instead as part of the microcontroller 20.

The bidirectional semiconductor switch 22''' of the lamp controller 12''' of the lighting system 10''' comprises a thyristor 22*c*, and a diode H-bridge 22*d*. The thyristor 22*c* is connected at its gate input to the output Z of the microcontroller 20. The diode H-bridge 22*d* is connected between the anode of the thyristor 22*c* and the lamp assembly 11. The diode H-bridge 22*d* comprises two legs of two series-connected diodes, and a 1 Meg-ohm resistor connected between one of the diode legs and signal ground for providing the microcontroller 20 with a fixed voltage reference for proper operation of the diode bridge 22*d*. The bidirectional switch 22''' functions in a manner similar to the semiconductor switch 22, but is advantageous since the cost of a thyristor is generally less than that of a triac.

Figure 1E:
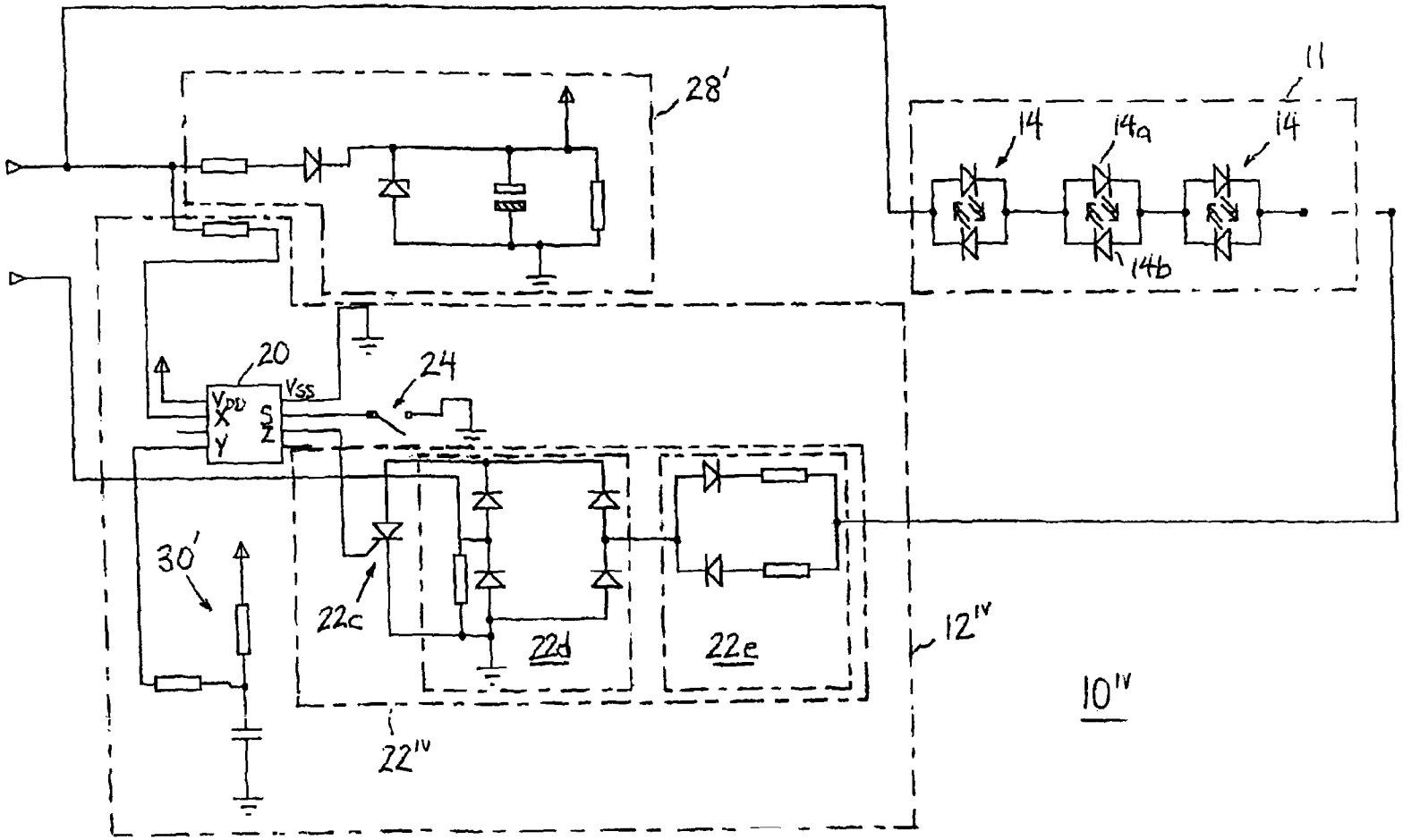
FIG. 1*e* is a schematic circuit diagram of a variable-effect lighting system, according to a fourth embodiment of the invention.

A fourth embodiment of the lighting system is depicted in FIG. 1*e*. As shown, the bidirectional semiconductor switch 22$^{iv}$ of the lamp controller 121$^{iv}$ of the lighting system 10$^{iv}$ comprises the thyristor 22*c*, the diode H-bridge 22*d* and a diode steering section 22*e*. The thyristor 22*c* is connected at its gate input to the output Z of the microcontroller 20. The diode H-bridge 22*d* is connected to the anode of the thyristor 22*c*, and the diode steering section 22*e* is connected between the diode H-bridge 22*d* and the lamp assembly 11.

The diode steering section 22*e* comprises a first steering diode in series with a first current-limiting resistor, and a second steering diode in series with a second current-limiting resistor. As shown, the first steering diode is connected at its anode to the diode H-bridge 22*d*, and is connected at its cathode to the first current-limiting resistor. The second steering diode is connected at its cathode to the diode H-bridge 22*d*, and is connected at its anode to the second current-limiting resistor.

In operation, when current flows from the voltage source through the lamps 14 in a first direction, the current is steered by the first steering diode through the first current-limiting resistor. When current flows from the voltage source through the lamps 14 in a second (opposite direction), the current is steered by the second steering diode through the second current-limiting resistor.

Typically, the forward voltage of the LEDs 14*a* may not be identical to the forward voltage of the LEDs 14*b*. As a result, generally the current conducted by the LEDs 14*a* may not be identical to the current conducted by the LEDs 14*b*. Therefore, the intensity of light produced by the LEDs 14*a* might not be identical to the intensity of light produced by the LEDs 14*b*. Further, even if the forward voltage of the LEDs 14*a* is the same as the forward voltage of the LEDs 14*b*, the intensity of light produced by the LEDs 14*a* might still not be identical to the intensity of light produced by the LEDs 14*b*. Using the diode steering section 22*e*, the intensity of light produced by the LEDs 14*a* can be matched to the intensity of light produced by the LEDs 14*b* by the appropriate selection of the values for the first and second current limiting resistors.

Although the diode steering section 22*e* is depicted in FIG. 1*e* as a separate circuit from the diode H-bridge 22*d*, the functionality of the diode steering section 22*e* can be incorporated into the diode H-bridge 22*d*, by relocating the first and second current-limiting resistors of the diode steering section 22*e* into respective legs of the diode H-bridge 22*d*, and eliminating the first and steering diodes. In this variant, the diodes of the H-bridge 22*d* would, in effect, perform the same function as the first and second steering diodes.

Further, the first and second current-limiting resistors of the diode steering section 22*e* are depicted in FIG. 1*e* as fixed resistances. However, the thyristor 22*c* and the diode H-bridge 22*d* can be eliminated, and the first and second current-limiting resistors replaced with electrically-variable resistors controlled by the microcontroller 20. In this latter variant, the intensity/colour produced by each lamp 14 can be controlled without having to calculate the conduction interval for each illuminating element 14*a*, 14*b*.

Thus far in the discussion, it has been assumed that the frequency of the AC voltage source has been constant. In the algorithm implemented in the assembly code listing shown in Table A, it was assumed that the frequency of the AC voltage source was constant at 60 Hz. In practice, the frequency of the AC voltage source might not be constant. Alternately, the frequency of the AC voltage source might be constant at some value other than 60 Hz. For instance, in some countries, the AC voltage is delivered to households at approximately 50 Hz. In either of these cases, the lamp controller 12 configured with the algorithm implemented in the assembly code listing shown in Table A would produce unpredictable results since the remaining conduction intervals calculated by the algorithm for each half cycle of the voltage source will not reflect the actual remaining conduction intervals.

Specifically, if the frequency of the voltage source is lower than expected, the period of the voltage source will be longer than expected. A point will be reached where the algorithm assumes that the LEDs 14*a* are fully on, and the LEDs 14*b* are fully off, at which point the algorithm will begin to reverse (i.e. will decrease the conduction interval of the LEDs 14*a*, and will increase the conduction interval of the LEDs 14*b*). However, at this point, the LEDs 14*a* will not be fully on, and the LEDs 14*b* will note be fully off. As a result, the colour produced by each lamp 14 will not be as expected.

Conversely, if the frequency of the voltage source is higher than expected, the period of the voltage source will be shorter than expected. A point will be reached where the LEDs 14*a* are fully on, and the LEDs 14*b* are fully off. However, at this point, the algorithm will assume that the LEDs 14*a* are not quite fully on, and the LEDs 14*b* are not quite fully off, at which point the algorithm will continue to increase the conduction interval of the LEDs 14*a*, and will continue to decrease the conduction interval of the LEDs 14*b*. As a result, the LEDs 14*a*, 14*b* will be turned on during the wrong half of the voltage cycle, thereby producing an unpredictable visual display.

Accordingly, rather than the algorithm assuming a fixed source voltage frequency, preferably the algorithm implemented by the lamp controller 12 (in any of the preceding embodiments of the lighting system) measures the period of time between instances of zero voltage crossings of the AC source voltage, and uses the calculated period to calculate the line frequency of the AC source voltage. By using the calculated line frequency, the algorithm is able to accurately track the actual conduction interval for the LEDs 14 during each half cycle of the AC voltage. The algorithm can calculate the line frequency on a cycle-by-cycle basis. However, for greater accuracy, preferably the algorithm calculates the line frequency over several AC voltage cycles.

Thus far in the description of the invention, the user-operable switch 24 has been used to cycle between the different conduction angle patterns. According to a fifth embodiment of the invention, the lamp controller is configured with only a single conduction angle algorithm, such as a continuous colour change or a continuous intensity change, and the user-operable switch 24 is used to start/stop the variation in the conduction angle. As a result, the user is able to fix or set the colour or intensity produced by the lamp assembly as desired, by simply depressing the user-operable switch 24 when the lamp controller has produced the desired colour or intensity. As above, preferably the current conduction angle is stored in EEPROM when the user-operable switch 24 is activated so that the lamp controller 12 reimplements the selected colour or intensity, using the stored conduction angle, after power has been removed and then reapplied to the lighting system.

If the user wishes to select a different colour or intensity, the user depresses the user-operable switch 24 again, thereby causing the conduction angle algorithm to resume the variation in colour or intensity. The user then presses the user-operable switch 24 again when the lamp controller has produced the new desired colour or intensity.

A sample assembly code listing for fixing the desired colour using a Microchip PIC12F629 microcontroller as the microcontroller 20 is shown below in Table B.

TABLE B

```
; The program consists of a fade routine in which the conduction angles of
; two sets of series-connected LEDs (connected back-to-back) are changed.
;   During the SCR trigger pulse, the user-operable switch 24 is monitored.
; Activation of the switch 24 toggles a FLAG. If the switch 24 is pressed
; when the fade is occurring, the current conduction angles are kept
; steady.   These values are also stored in EEPROM so that the information
; is retained in the event of a power loss.   On power up, the previous
; state is retrieved from the EEPROM.
 LIST P=12f629, F=INHX8M
      LIST FREE
  #include "p12f629.inc"
 ; Constants
Start_Stop EQU 0
Button EQU 0 ; Button on GPIO,0
AC_IN EQU 5 ; AC input on GPIO,5
TRIGGER_OUT EQU 1; Triac Trigger on GPIO,1
min_intensity EQU .80 ; values for min and max delays of trigger pulse
max_intensity EQU .30
Flag_Address EQU 0 ; location where start/stop status is stored
Intensity_Address EQU 1 ; location where current intensity is stored
Position_Address EQU 2 ; location which says where in the fade routine program was ;
stopped
; variables
delay_dim EQU 0x020
dim_val EQU 0x021
trigger_delay EQU 0x022
RED_INTENSITY EQU 0x023
SUBTRACT_REG EQU 0x024
DELAY5 EQU 0x025
FADE_DELAY EQU 0x026
FLAG EQU 0x027
Dlay EQU 0x028
DELAY1 equ 0x029
DELAY2 equ 0x02a
DELAY3 equ 0x02b
ADDRESS equ 0x02C
DATA_B equ 0x02D
POSITION EQU 0x02E
     ORG        0x000              ; processor reset vector
```

TABLE B-continued

```
    goto        start                   ; go to beginning of program
org 0x007
WAIT_NEG_EDGE1 ; wait here till negative going pulse
    btfsc GPIO,AC_IN
    goto WAIT_NEG_EDGE1
    decfsz DELAY5,1; after FADE_DELAY counted down, increase RED_INTENSITY
    return
    btfss FLAG,Start_Stop       ; if flag set, don't fade
                                ; (i.e. don't increment intensity register)
    incf RED_INTENSITY,1
    movf FADE_DELAY,0
    movwf DELAY5
    return
WAIT_NEG_EDGE2
    btfsc GPIO,AC_IN
    goto WAIT_NEG_EDGE2
    decfsz DELAY5,1; after FADE_DELAY counted down, decrease RED_INTENSITY
    return
    btfss FLAG,Start_Stop ; if flag set, don't decrement intensity register
    decf RED_INTENSITY,1
    movf FADE_DELAY,0
    movwf DELAY5
    return
start
    call        0x3FF                   ; retrieve factory calibration value
    bsf         STATUS,RP0              ; set file register bank to 1
    movwf       OSCCAL                  ; update register with factory cal value
    movlw b'0000000'                    ; enable pullup on GPIO,0
    movwf WPU
    bcf         STATUS,RP0              ; set file register bank to 0
    bcf FLAG,Start_Stop ; reset fade stop flag
    movlw b'00000111'
    movwf CMCON
    movlw b'00101011' ; GP0 button input, GP1 trigger SCR
                      ; GP3 Reset, GP5 A.C. timing pulse
    TRIS GPIO
    movlw b'00011111' ; prescale wdt 128,
    OPTION
    movlw max_intensity
    movwf RED_INTENSITY
    movlw .7 ;
    movwf DELAY5 ; counter for FADE_DELAY determines fade speed
    movwf FADE_DELAY
    movlw Flag_Address ; check state (1 = fade stopped, 0 = fade)
    movwf ADDRESS
    call EE_READ
    movf DATA_B,0
    movwf FLAG ; only one bit used so can use reg.
    btfss FLAG,Start_Stop ;if fade stopped get intensity
    goto FADE_SLOWB ; otherwise continue
    movlw Intensity_Address
    movwf ADDRESS ; get intensity value
    call EE_READ
    movf DATA_B,0
    movwf RED_INTENSITY
    movlw Position_Address ; find out where in program it was stopped
    movwf ADDRESS
    call EE_READ
    movf DATA_B,0
    movwf POSITION      ; save position in POSITION variable
    movlw .1        ; determine where in program too jump to
    subwf POSITION,0
    btfsc STATUS,Z
    call POSITION1
    movlw .2
    subwf POSITION,0
    btfsc STATUS,Z
    call POSITION2
    movlw .3
    subwf POSITION,0
    btfsc STATUS,Z
    call POSITION3
    movlw .4
    subwf POSITION,0
    btfsc STATUS,Z
    call POSITION4
FADE_SLOWB ; fade between colors
    movlw .7 ; determines fade speed ie. 1 would be a fast fade
    movwf FADE_DELAY
    call WAIT_NEG1 ;
```

TABLE B-continued

```
        movlw max_intensity
        movwf RED_INTENSITY
        goto FADE_SLOWB
DELAY
        movwf dim_val ; used to set up time to trigger scr
LOOP1
        movlw .27
        movwf delay_dim
LOOP2 decfsz delay_dim,1
        goto LOOP2
        decfsz dim_val,1
        goto LOOP1
        return
EE_READ ; routines to read and write to EEPROM
        movf ADDRESS,0
        bsf STATUS,RP0
        movwf EEADR
        bsf EECON1,RD
        movf EEDATA,w
        bcf STATUS,RP0
        movwf DATA_B
        return
EE_WRITE
        movf DATA_B,0
        bsf STATUS,RP0
        movwf EEDATA
        bcf STATUS,RP0
        movf ADDRESS,0
        bsf STATUS,RP0
        movwf EEADR
        bsf EECON1,WREN
        movlw 55h
        movwf EECON2
        movlw 0x0AA
        movwf EECON2
        bsf EECON1,WR
Write_Loop
        btfsc EECON1,WR
        goto Write_Loop ; stay in loop till complete
        bcf EECON1,WREN
        bcf STATUS,RP0
        return
Check_Button
        movlw .4 ; check button and debounce
        movwf DELAY3
SEC2
        movlw .25
        movwf DELAY2
QUART_SEC2
        movlw .250
        movwf DELAY1
MSEC2
        clrwdt
        decfsz DELAY1,1
        goto MSEC2
        decfsz DELAY2,1
        goto QUART_SEC2
        decfsz DELAY3,1
        goto SEC2
        btfss GPIO,Button
        goto $-1
        movlw .4
        movwf DELAY3
SEC3
        movlw .250
        movwf DELAY2
QUART_SEC3
        movlw .25
        movwf DELAY1
MSEC3
        clrwdt
        decfsz DELAY1,1
        goto MSEC3
        decfsz DELAY2,1
        goto QUART_SEC3
        decfsz DELAY3,1
        goto SEC3
        movlw b'00000001' ;when button pressed toggle flag from stopped
                                ; to fade position
        xorwf FLAG,1
```

TABLE B-continued

```
        movlw Flag_Address
        movwf ADDRESS
        movf FLAG,0
        movwf DATA_B
        call EE_WRITE ; save values in EEPROM
        movlw Intensity_Address
        movwf ADDRESS
        movf RED_INTENSITY,0
        movwf DATA_B
        call EE_WRITE
        movlw Position_Address
        movwf ADDRESS
        movf POSITION,0
        movwf DATA_B
        call EE_WRITE
        return
TRIGGER         ; trigger pulse to SCR
                ; button press is checked during each trigger pulse
        clrwdt
        bsf GPIO,TRIGGER_OUT
        movlw b'00101001' ;
        TRIS GPIO
        movlw .30
        movwf trigger_delay
LOOP3
        decfsz trigger_delay,1
        goto LOOP3
        bcf GPIO,TRIGGER_OUT
        movlw b'00101011' ;
        TRIS GPIO
        btfss GPIO,Button ; if button pressed check it
        call Check_Button
        return
FADE_SUB ; subroutine for fading (4 positions in fade sequence)
UP_LOOP
POSITION1
        movlw .1
        movwf POSITION
        btfss GPIO,AC_IN ;
        goto UP_LOOP ; RED LOOP
WAIT_NEG1
        call WAIT_NEG_EDGE1
NO_CHANGE
        movlw min_intensity ;
        subwf RED_INTENSITY,0
        btfsc STATUS,Z
        goto WAIT_NEG2 ;DOWN_LOOP
        movf RED_INTENSITY,0 ; (RED_INTENSITY−min_intensity)
        call DELAY
        call TRIGGER
MAIN_LOOP2
        btfsc GPIO,AC_IN
        goto MAIN_LOOP2
WAIT_POS_EDGE1
        btfss GPIO,AC_IN
        goto WAIT_POS_EDGE1
        movlw max_intensity
        call DELAY
        call TRIGGER
        goto UP_LOOP
DOWN_LOOP
POSITION2
        movlw .2
        movwf POSITION
        btfss GPIO,AC_IN
        goto DOWN_LOOP
WAIT_NEG2
        call WAIT_NEG_EDGE2
NO_CHANGE2
        movlw max_intensity
        subwf RED_INTENSITY,0
        btfsc STATUS,Z
        goto GREEN_DOWN_RED_ON
        movf RED_INTENSITY,0
        call DELAY
        call TRIGGER
MAIN_LOOP3
        btfsc GPIO,AC_IN ;
        goto MAIN_LOOP3
WAIT_POS_EDGE2
```

TABLE B-continued

```
    btfss GPIO,AC_IN
    goto WAIT_POS_EDGE2
    movlw max_intensity
    call DELAY
    call TRIGGER
    goto DOWN_LOOP
GREEN_DOWN_RED_ON
    movlw min_intensity
    movwf RED_INTENSITY
    goto WAIT_NEG2C
GREEN_DOWN_RED_ONB
POSITION3
    movlw .3
    movwf POSITION
    btfss GPIO,AC_IN ;
    goto GREEN_DOWN_RED_ONB
WAIT_NEG2C
    call WAIT_NEG_EDGE2
NO_CHANGE2C
    movlw max_intensity
    subwf RED_INTENSITY,0
    btfsc STATUS,Z
    goto WAIT_NEG1C
    movlw max_intensity
    call DELAY
    call TRIGGER
MAIN_LOOP3C
    btfsc GPIO,AC_IN
    goto MAIN_LOOP3C
WAIT_POS_EDGE2C
    btfss GPIO,AC_IN
    goto WAIT_POS_EDGE2C
    movlw min_intensity+max_intensity
    movwf SUBTRACT_REG
    movf RED_INTENSITY,0
    subwf SUBTRACT_REG,0
    call DELAY
    call TRIGGER
    goto GREEN_DOWN_RED_ONB
GREEN_UP_RED_ON
POSITION4
    movlw .4
    movwf POSITION
    btfss GPIO,AC_IN ;
    goto GREEN_UP_RED_ON
WAIT_NEG1C
    call WAIT_NEG_EDGE1
NO_CHANGEC
    movlw min_intensity
    subwf RED_INTENSITY,0
    btfss STATUS,Z
    goto Continue_Loop
    movlw max_intensity ;start over
    movwf RED_INTENSITY
    goto WAIT_NEG1
Continue_Loop
    movlw max_intensity
    call DELAY
    call TRIGGER
MAIN_LOOP2C
    btfsc GPIO,AC_IN ;
    goto MAIN_LOOP2C
WAIT_POS_EDGE1C
    btfss GPIO,AC_IN
    goto WAIT_POS_EDGE1C
    movlw max_intensity+min_intensity
    movwf SUBTRACT_REG
    movf RED_INTENSITY,0
    subwf SUBTRACT_REG,0
    call DELAY
    call TRIGGER
    goto GREEN_UP_RED_ON
        ;
    end
```

In a sixth embodiment (not shown), the lamp controller includes two user-operable inputs, and implements both the colour/intensity selection algorithm of the fifth embodiment and the multiple conduction angle pattern algorithms of the first through fourth embodiments. In this sixth embodiment, one of the user-operable inputs is used to select the desired conduction angle pattern, and the other user-operable inputs is used to start/stop the selected conduction angle pattern at a desired point.

An inherent advantage of each of the preceding embodiments is that they are all self-synchronizing. For instance, in each the preceding embodiments, if multiple lamp controllers were powered by a common AC voltage source, and were configured with the same predetermined display pattern(s), the visual display produced by each corresponding lamp assembly would be synchronized with the visual display produced by the other lamp assemblies. Thus, for example, in a household environment where several 120 VAC receptacles are connected in parallel with the same voltage source, all lamp assemblies would be synchronized with one another, even if the corresponding lamp controllers were plugged into different receptacles.

In each of the foregoing sample algorithms, the value of the RED_INTENSITY variable is increased/decreased after FADE_DELAY iterations of the WAIT_NEG_EDGE1 and WAIT_NEG_EDGE2 subroutines. Since the value of the RED_INTENSITY variable determines the conduction interval of each of the LEDs 14, the rate of change of the colour produced by the lamp assembly is fixed by the value assigned to the FADE_DELAY variable. In a seventh embodiment, the rate of change of colour is not fixed but is determined by a signal source external to the lamp controller. In this embodiment, instead of the WAIT_NEG_EDGE1 and WAIT_NEG_EDGE2 subroutines increasing/decreasing the value of the RED_INTENSITY variable at a predetermined rate, the algorithm increases/decreases the value assigned to the RED_INTENSITY variable based on an external signal. Preferably, the value assigned to the RED_INTENSITY variable is based on a digital signal applied to the lamp controller, such as a DMX signal. However, in one variation, the microcontroller includes an analog-to-digital converter, and the value assigned to the RED_INTENSITY variable is based on the magnitude of an analog signal applied to the input of the analog-to-digital converter. An advantage of this embodiment is that the user is not confined to a predetermined set of visual effects, but can control the visual effect produced by the lamp assembly based on an external electrical signal applied to the lamp controller.

Figure 2A:
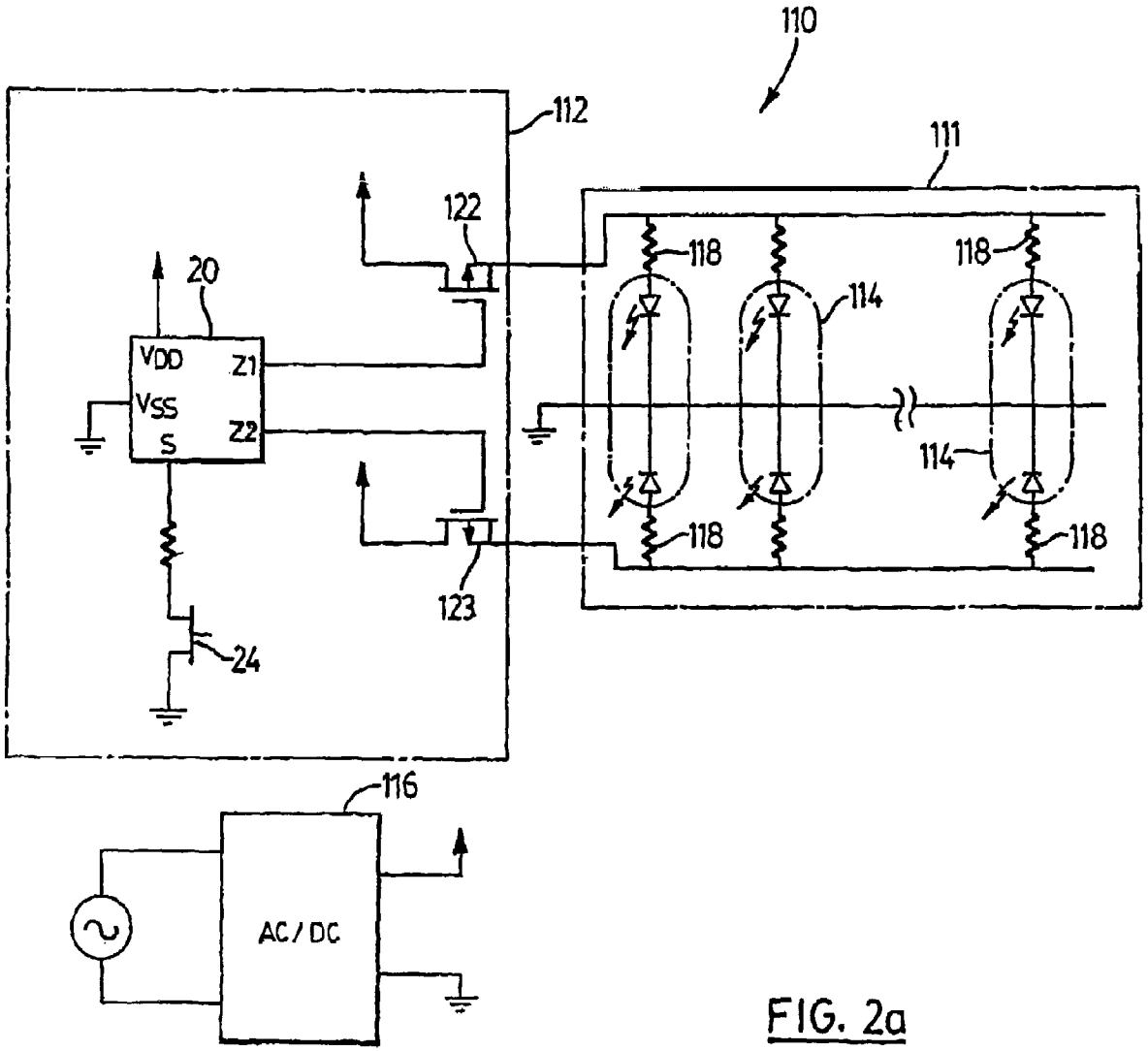
FIG. 2*a* is a schematic circuit diagram of a variable-effect lighting system according to an eighth embodiment of the invention, wherein the lamp assembly comprises a string of parallel-coupled bicoloured lamps.

Turning to FIG. 2*a*, a variable-effect lighting system according to an eighth embodiment of the invention, denoted generally as 110, is shown comprising a lamp assembly 111, and a lamp controller 112 coupled to the lamp assembly 111 for setting the colour of light produced by the lamp assembly 111.

The lamp assembly 111 comprises a string of multi-coloured lamps 114 connected in parallel with each other. The multi-coloured lamps 114 are also connected in parallel with an AC/DC converter 116 which is coupled to an AC voltage source. Each lamp 114 comprises a bicoloured LED having a first illuminating element for producing a first colour of light, and a second illuminating element for producing a second colour of light which is different from the first colour, with the leads of each lamp 114 configured such that when current flows through one lead the first colour of light is produced, and when current flows through the another lead the second colour of light is produced. As shown in FIG. 2*a*, preferably each bicoloured LED comprises first and second differently-coloured LEDs 114*a*, 114*b* in series with a respective current-limiting resistor 118, with the common cathode of the LEDs 114 being connected to ground, and with the first illuminating element comprising the first LED 114*a* and the second illuminating element comprising the second LED 114*b*.

The AC/DC converter 116 produces a DC output voltage of a magnitude which is sufficient to power the lamps 114, but which will not damage the lamps 114. Typically, the AC/DC converter 116 receives 120 volts AC at its input and produces an output voltage of about 5 volts DC.

Preferably, the controller 112 is also powered by the output of the AC/DC converter 116 and comprises a microcontroller 20, a first semiconductor switch 122 controlled by an output Z1 of the microcontroller 20, a second semiconductor switch 123 controlled by an output Z2 of the microcontroller 20, and a user-operable switch 24 coupled to an input S of the microcontroller 20 for selecting the colour display desired. As discussed above, the user-operable switch 24 may be eliminated if desired. In FIG. 2*a*, the semiconductor switches 122, 123 are shown comprising MOSFET switches. However, other semiconductor switches may be used without departing from the scope of the invention.

The first semiconductor switch 122 is connected between the output of the AC/DC converter 116 and the anode of the first LED 114*a* (through the first current-limiting resistor 118), while the second semiconductor switch 123 is connected between the output of the AC/DC converter 116 and the anode of the second LED 114*b* (through the second current-limiting resistor 118). However, the anodes of the LEDs 114*a*, 114*b* may be coupled instead to the output of the AC/DC converter, with the first and second semiconductor switches 122, 123 being connected between the respective cathodes and ground. Other variations on the placement of the semiconductor switches 122, 123 will be apparent to those skilled in the art.

As with the previously described embodiments, the microcontroller 20 includes a non-volatile memory which is programmed with preferably several conduction angle sequences for setting the firing angle of the semiconductor switches 122, 123 in accordance with the sequence selected. In this manner, the conduction angles of the LEDs 114*a*, 114*b*, and hence the ultimate colour display generated by the lamps 114 can be selected. Alternately, as discussed above, the microcontroller 20 may be replaced with a dedicated integrated circuit (ASIC) that is "hard-wired" with one or more conduction angle sequences.

The operation of the variable-effect lighting system 110 is similar to the operation of the variable-effect lighting system 10. After power is applied to the AC/DC converter 116, the microcontroller 20 begins executing instructions for implementing one of the conduction angle sequences. Again, assuming that the first conduction angle sequence, identified above, is selected, the microcontroller 20 issues a signal to the first semiconductor switch 122, causing the first LED 114*a* to illuminate. After a predetermined period has elapsed, the signal to the first semiconductor switch 122 is removed, causing the first LED 114*a* to extinguish. While the LED 114*a* is conducting current, the predetermined period for the first LED 114*a* is decreased in preparation for the next cycle.

The microcontroller 20 then issues a signal to the second semiconductor switch 123, causing the second LED 114*b* to illuminate. After a predetermined period has elapsed, the signal to the second semiconductor switch 123 is removed, causing the second LED 114*b* to extinguish. While the second LED 114*b* is conducting current, the predetermined period for the second LED 114*b* is increased in preparation for the next cycle.

With the above conduction angle sequence, it will be apparent that the period of time each cycle during which the first LED 114*a* illuminates will continually decrease, while the period of time each cycle during which the second LED 114*b* illuminates will continually increase. Therefore, the colour of light emanating from the lamps 114 will gradually change from the colour of the first LED 114*a* to the colour of the second LED 114*b*, with the colour of light emanating from the lamps 114 when both the LEDs 114*a*, 114*b* are conducting being determined by the instantaneous ratio of the magnitude of the conduction period of the first LED 114*a* to the magnitude of the conduction period of the second LED 114*b*.

Figure 2B:
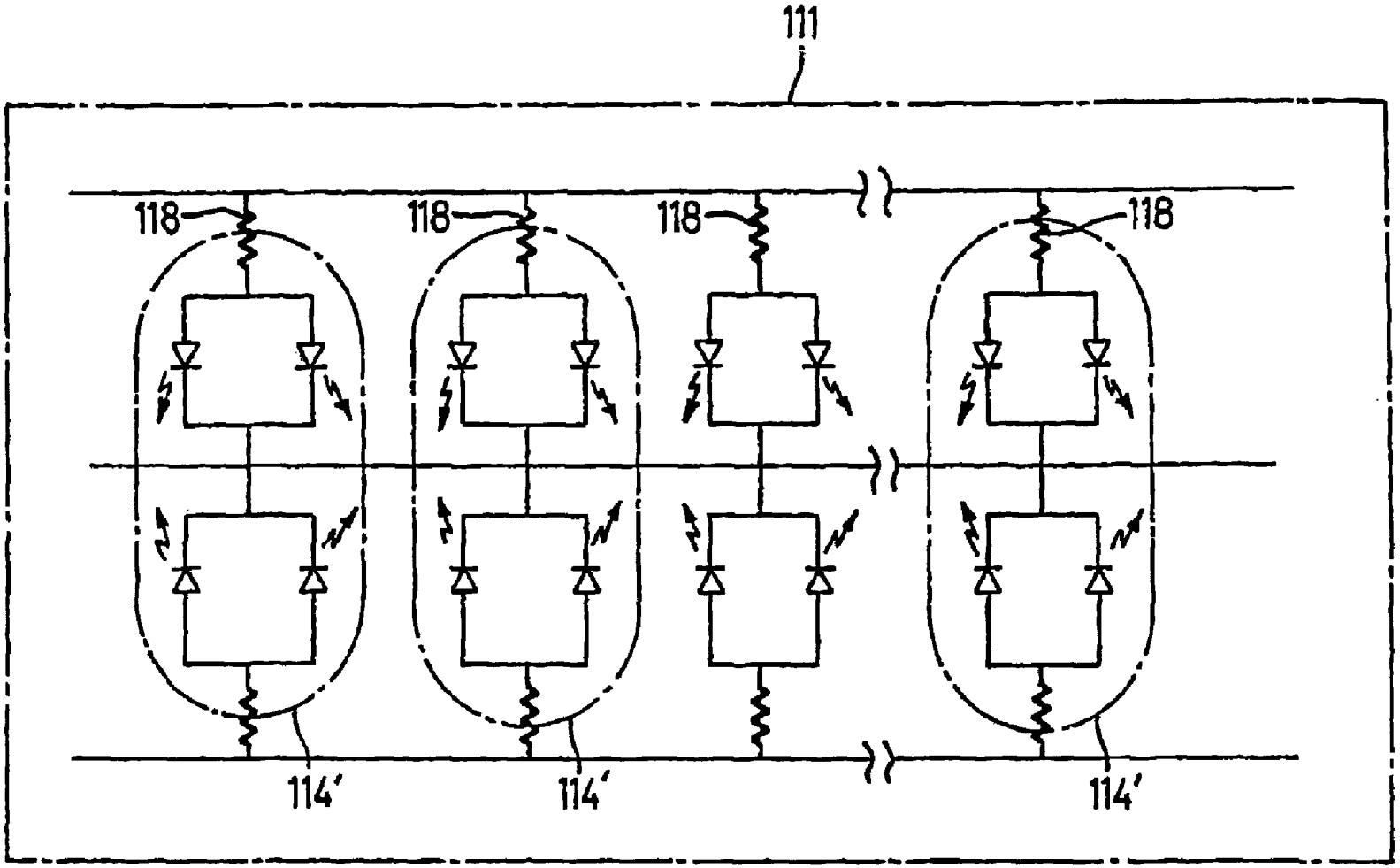
FIG. 2*b* is a schematic circuit diagram of one variation of the lamp assembly shown in FIG. 2*a;*

Numerous variations of the lighting system 110 are also possible. In one variation, each lamp 114 comprises a pair of LEDs with one of the LEDs being capable of emitting white light and with the other of the LEDs being capable of producing a colour of light other than white. In another variation, each lamp 114 comprises a LED capable of producing three or more different colours of light, while in the variation shown in FIG. 2*b*, each lamp 114 comprises three or more differently-coloured LEDs. In these latter two variations, the LEDs are connected such that when current flows through one of the semiconductor switches one colour of light is produced, and when current flows through the other of the semiconductor switches another colour of light is produced.

Figure 2C:
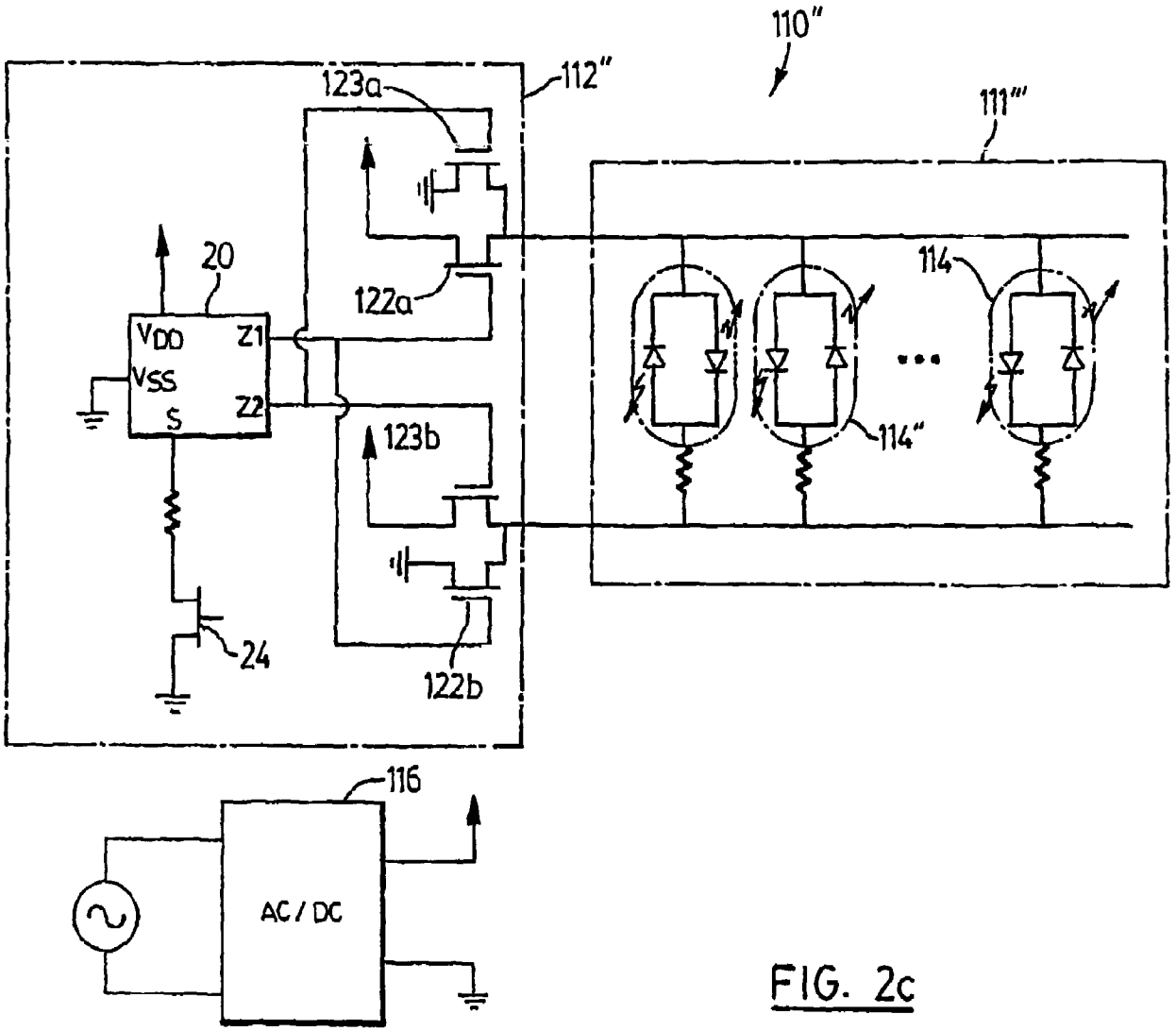
FIG. 2*c* is a schematic circuit diagram of a variable-effect lighting system, according to an ninth embodiment of the invention.

A ninth embodiment of the lighting system is depicted in FIG. 2*c*. As shown, the controller 112 includes a first pair of electronic switches 122*a*, 122*b* driven by the output Z1 of the microcontroller 20, and a second pair of electronic switches 123*a*, 123*b* driven by the output Z1 of the microcontroller 20. Each pair of first and second LEDs 114*a*, 114*b* of each lamp 114 are connected back-to-back, such that the lamps 114 and the semiconductor switches 122, 123 are configured together as an H-bridge. As discussed above, preferably the first and second LEDs 114*a*, 114*b* produce different colours, although the invention is not intended to be so limited.

Figure 3:
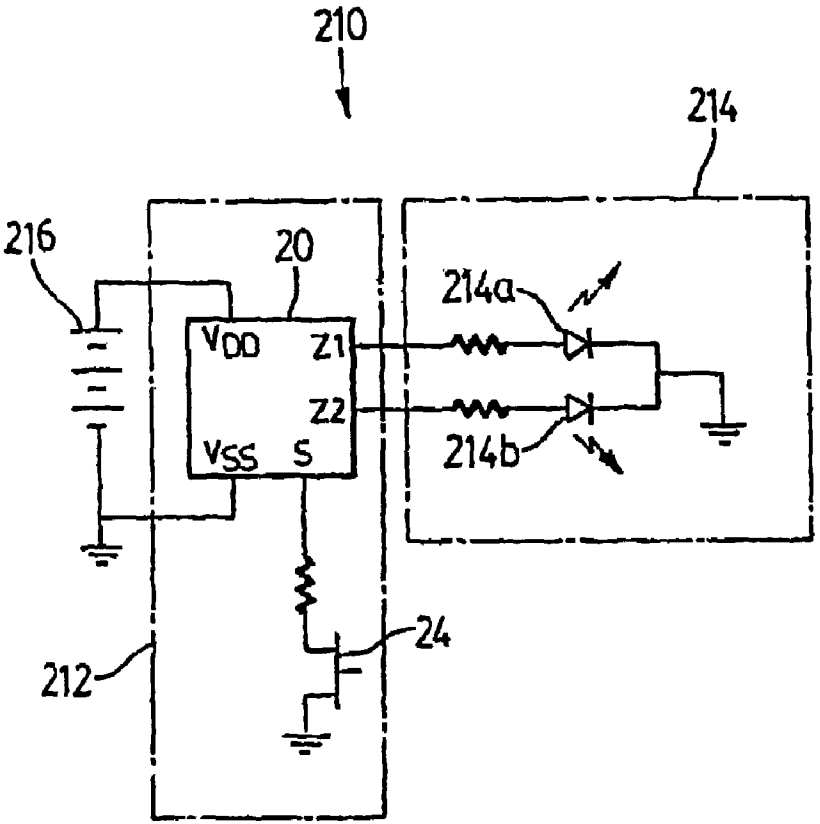
FIG. 3 is a schematic circuit diagram of a variable-effect lighting system according to a tenth embodiment of the invention, wherein the lamp controller directly drives each bicoloured lamp.

Turning to FIG. 3, a variable-effect lighting system according to a tenth embodiment of the invention, denoted generally as 210, is shown comprising a multi-coloured lamp 214, and a lamp controller 212 coupled to the multi-coloured lamp 214 for setting the colour of light produced by the lamp 214. The multi-coloured lamp 114 comprises a bicoloured LED having a first illuminating element for producing a first colour of light, and a second illuminating element for producing a second colour of light which is different from the first colour. As shown in FIG. 3, preferably the first illuminating element comprises a red-coloured LED 214*a*, and the second illuminating element comprises a green-coloured LED 214*b*, with the common cathode of the LEDs 214*a*, 214*b* being connected to ground. As discussed above, multi-coloured LEDs and/or arrangements of differently-coloured discrete LEDs and/or translucent ornamental bulbs may be used if desired.

The lamp controller 212 is powered by a 9-volt battery 216, and comprises a microcontroller 20, and a user-operable switch 24 coupled to an input S of the microcontroller 20 for selecting the colour display desired. Alternately, for applications where space is at a premium, the lamp controller 212 may be powered by a smaller battery producing a smaller voltage. If necessary, the smaller battery may be coupled to the lamp controller 212 through a voltage amplifier, such as a DC-to-DC converter.

As discussed above, the microcontroller 20 may be replaced with a dedicated integrated circuit (ASIC) that is "hard-wired" with one or more conduction angle sequences. Also, the user-operable switch 24 may also be eliminated if desired.

An output Z1 of the microcontroller 20 is connected to the anode of the red LED 214*a*, and an output Z2 of the microcontroller 20 is connected to the anode of the green LED 214*b*. Since the lamp 214 is driven directly by the microcontroller 20, the variable-colour ornamental lighting system 210 is limited to applications requiring only a small number of lamps 214.

The operation of the variable-effect lighting system 210 will be readily apparent from the foregoing discussion and, therefore, need not be described.

Figure 4:
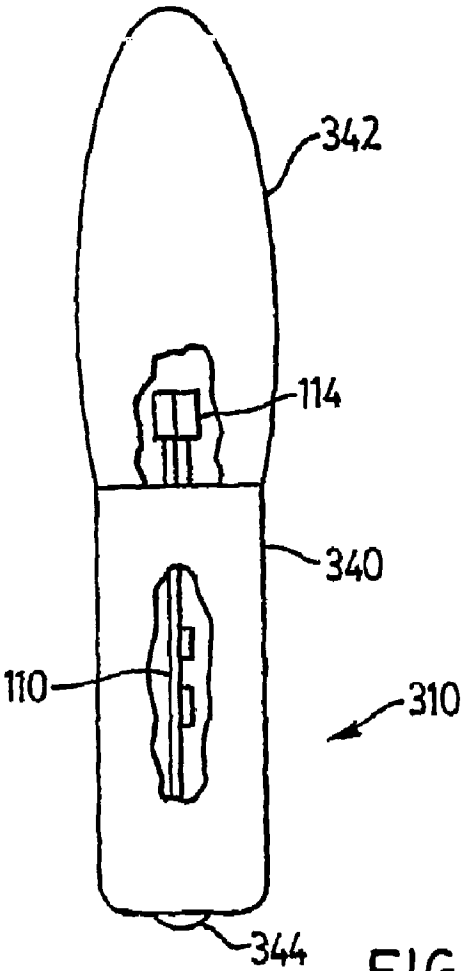
FIG. 4 is a night light according to one implementation of the embodiment shown in FIG. 2.

Turning now to FIG. 4, a night light 310 is shown comprising the variable-effect lighting system 110, described above, but including only a single multi-coloured lamp 114, a housing 340 enclosing the lamp controller 112 and the AC/DC converter 116, and a translucent bulb 342 covering the lamp 114 and fastened to the housing 340. Preferably, the housing 340 also includes an ambient light sensor 344 connected to the microcontroller 20 for inhibiting conduction of the lamp 114 when the intensity of ambient light exceeds a threshold.

Figure 5B:
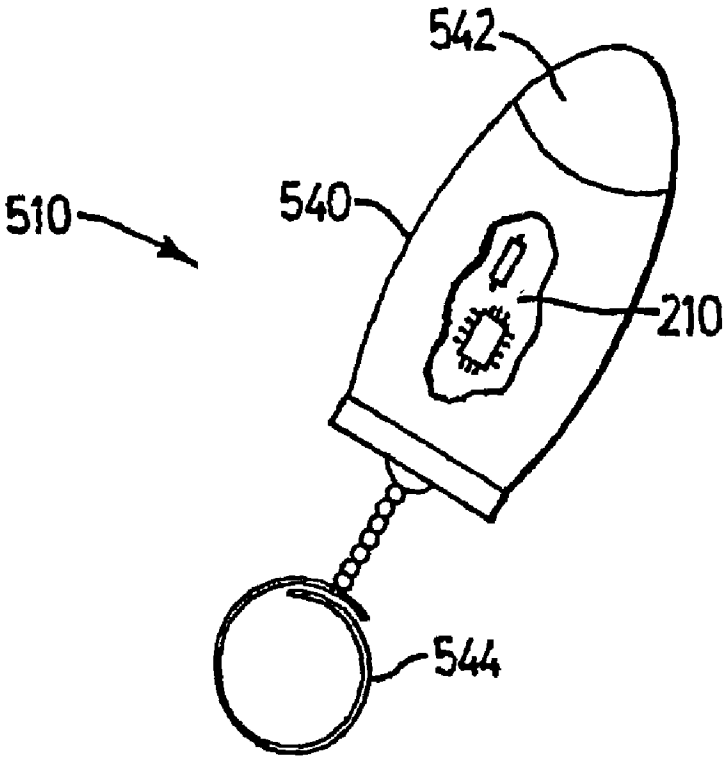
FIG. 5*b* is a key chain according to another implementation of the embodiment shown in FIG. 3.
Figure 5A:
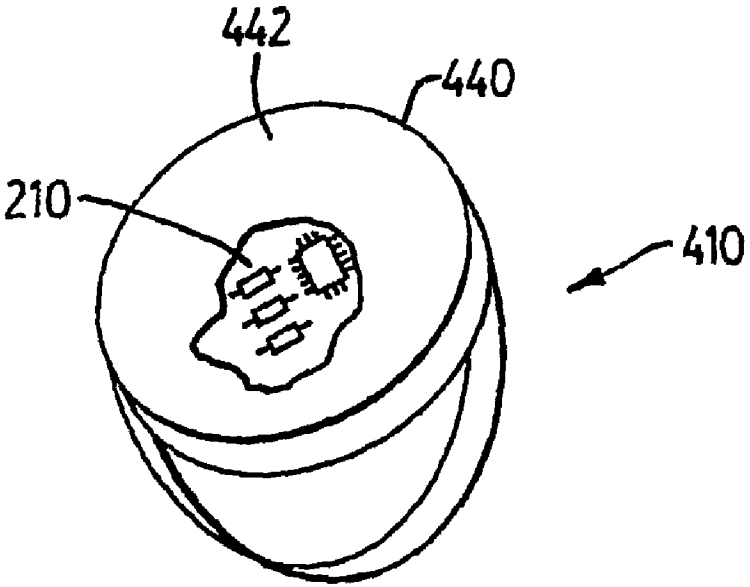
FIG. 5*a* is a jewelry piece according to one implementation of the embodiment shown in FIG. 3.

In FIG. 5*a*, a jewelry piece 410, shaped as a ring, is shown comprising the variable-effect lighting system 210, described above, and a housing 440 retaining the lamp 214, the lamp controller 212, and the battery 216 therein. A portion 442 of the housing 440 is translucent to allow light to be emitted from the lamp 214. In FIG. 5*a*, a key chain 510, is shown comprising the variable-colour ornamental lighting system 210, and a housing 540 retaining the lamp 214, the lamp controller 212, and the battery 216 therein. A portion 542 of the housing 540 is translucent to allow light to be emitted from the lamp 214. A key clasp 544 is coupled to the housing 540 to retain keys. Both the jewelry piece 410 and the key chain 510 may optionally include a user-operable input for selecting the conduction angle pattern.

The present invention is defined by the claims appended hereto, with the foregoing discussion describing preferred embodiments of the invention. Persons of ordinary skill may envision certain modifications to the described embodiments which, although not explicitly suggested herein, do not depart from the scope of the invention, as defined by the appended claims

The invention claimed is:

1. A variable-effect lighting system comprising:

a lamp assembly comprising a plurality of multi-coloured lamps in series with an AC voltage source and in series with each other, the voltage source having a frequency, each said multi-coloured lamp comprising a first illuminating element for producing a first colour of light, and a second illuminating element for producing a second colour of light; and a lamp controller coupled to the lamp assembly for varying the colour produced by the lamps by varying a conduction interval of each said illuminating element according to a predetermined pattern, the controller being configured to terminate the variation upon activation of a user-operable input to the controller, wherein the lamp controller includes a non-volatile memory and is configured to retain in the non-volatile memory a datum associated with the conduction interval of one of the illuminating elements upon the activation of the user-operable input, the lamp controller being further configured to set the conduction interval of the one illuminating element in accordance with the retained datum upon re-application of power to the lighting system.

2. The lighting system according to claim 1, wherein the lamp controller is configured to resume the variation upon activation of the user-operable input.

3. The lighting system according to claim 1, wherein the lamp controller is configured to vary the conduction interval of each said illuminating element according to an external signal input to the lamp controller.

4. The lighting system according to claim 3, wherein the lamp controller is configured to adjust a speed of the colour variation based on the external signal.

5. The lighting system according to claim 1, wherein the lamp controller includes an electronic switch coupled to the multi-coloured lamps, the electronic switch comprising a diode H-bridge and thyristor coupled to the diode H-bridge, and the lamp controller is configured to determine the activation of the user-operable input upon triggering of the thyristor.

6. The lighting system according to claim 5, wherein the electronic switch includes a diode steering section coupled to the diode H-bridge and the multi-coloured lamps for equalizing an intensity of the first colour with an intensity of the second colour.

7. The lighting system according to claim 6, wherein the diode H-bridge includes a diode steering section coupled to the multi-coloured lamps for equalizing an intensity of the first colour with an intensity of the second colour.

8. The lighting system according to claim 7, wherein the diode steering section comprises a first steering diode in series with a first current-limiting resistor, and a second steering diode in series with a second current-limiting resistor, the first steering diode being disposed to conduct a current through the multi-coloured lamps in a first direction and to block said current in a second direction opposite the first direction, the second steering diode being disposed to conduct said current in the second direction and to block said current in the first direction.

9. The lighting system according to claim 8, wherein the first and second current-limiting resistors comprise electronically-variable resistors, and the electronic switch further comprises a resistor controller coupled to the electronically-variable resistors for controlling a magnitude of a current through each said illuminating element.

10. The lighting system according to claim 6, wherein the electronic switch comprises an electronically-variable resistor coupled to the diode steering section, and a resistor controller coupled to the electronically-variable resistor for controlling a magnitude of a current through each said illuminating element.

11. A variable-effect lighting system comprising:

a lamp assembly comprising a plurality of multi-coloured lamps in series with an AC voltage source and in series with each other, the voltage source having a frequency, each said multi-coloured lamp comprising a first illuminating element for producing a first colour of light, and a second illuminating element for producing a second colour of light; and a lamp controller coupled to the lamp assembly for varying the colour produced by the lamps by varying a conduction interval of each said illuminating element according to an external digital signal input to the lamp controller, wherein the lamp controller is configured to adjust a speed of the colour variation based on the external signal input.

12. The lighting system according to claim 11, wherein the lamp controller includes an electronic switch coupled to the multi-coloured lamps, the electronic switch comprising a diode H-bridge and thyristor coupled to the diode H-bridge.

13. The lighting system according to claim 12, wherein the electronic switch includes a diode steering section coupled to the diode H-bridge and the multi-coloured lamps for equalizing an intensity of the first colour with an intensity of the second colour.

14. The lighting system according to claim 12, wherein the diode H-bridge includes a diode steering section coupled to the multi-coloured lamps for equalizing an intensity of the first colour with an intensity of the second colour.

15. The lighting system according to claim 13, wherein the diode steering section comprises a first steering diode in series with a first current-limiting resistor, and a second steering diode in series with a second current-limiting resistor, the first steering diode being disposed to conduct a current through the multi-coloured lamps in a first direction and to block said current in a second direction opposite the first direction, the second steering diode being disposed to conduct said current in the second direction and to block said current in the first direction.

16. The lighting system according to claim 15, wherein the first and second current-limiting resistors comprise electronically-variable resistors, and the electronic switch further comprises a resistor controller coupled to the electronically-variable resistors for controlling a magnitude of a current through each said illuminating element.

17. The lighting system according to claim 13, wherein the electronic switch comprises an electronically-variable resistor coupled to the diode steering section, and a resistor controller coupled to the electronically-variable resistor for controlling a magnitude of a current through each said illuminating element.

* * * * *